United States Patent [19]

Faillon et al.

[11] Patent Number: 5,043,630

[45] Date of Patent: Aug. 27, 1991

[54] ELECTRON GUN WITH ELECTRON BEAM MODULATED BY AN OPTICAL DEVICE

[75] Inventors: Georges Faillon, Meudon; Alexis Dubrovin, Paris Cedex, both of France

[73] Assignee: Thomson Tubes Electroniques, Boulogne Billancourt, France

[21] Appl. No.: 475,303

[22] Filed: Feb. 5, 1990

[30] Foreign Application Priority Data

Feb. 21, 1989 [FR] France ..... 89 02236

[51] Int. Cl.[5] ..... H01J 25/02

[52] U.S. Cl. ..... 315/5

[58] Field of Search ..... 315/4, 5, 383; 313/524

[56] References Cited

U.S. PATENT DOCUMENTS

| | | | |
|---|---|---|---|
| 3,239,670 | 3/1966 | Bloembergen . | |
| 3,764,807 | 10/1973 | Pollack | 250/330 |
| 4,608,569 | 8/1986 | Dickey, Jr. et al. | 342/384 |
| 4,703,228 | 10/1987 | West . | |
| 4,749,906 | 6/1988 | Tran et al. | 315/5 |
| 4,763,996 | 8/1988 | Hara et al. | 350/387 |

FOREIGN PATENT DOCUMENTS 0298817 1/1989 European Pat. Off. .

OTHER PUBLICATIONS

International Electron Devices Meeting, Washington, D.C., Dec. 1-4, 1985, pp. 342-345, M. Shrader et al., "Pre-Bunched Beam Devices—Efficient Sources of UHF and Microwave Power".

The Microwave Journal, vol. 7, No. 8, Aug. 1964, pp. 51-56, Horizon House, Dedham, U.S., K. M. Johnson, "Microwave Light Modulation by the Pockel Effect".

IEEE Transactions on Nuclear Science, vol. NS-32, No. 5, part 2, New York, U.S.A., Oct. 1985, pp. 2906-2908, E. L. Garwin et al., "An Experimental Program to Build a Multimegawatt Lasertron for Super Linear Colliders".

*Primary Examiner*—Theodore M. Blum

*Attorney, Agent, or Firm*—Oblon, Spivak, McClelland, Maier & Neustadt

[57] ABSTRACT

The device according to the invention comprises a photocathode (1) illuminated by a luminous source (11) modulated at a high frequency F by an optical device (15) controlled at the frequency F, the optical device (15) being interposed between the luminous source and the photocathode. According to one aspect of the invention, the optical modulator (15) is controlled by a surrounding electromagnetic field at a high frequency F, in which the modulator is immersed. The electron gun device according to another aspect of the invention can be associated to a microwave circuit to obtain microwave oscillator or amplifier tubes. According to another aspect of the invention, the device supplies a pulsed electron beam for injection into particle accelerators.

13 Claims, 3 Drawing Sheets

ELECTRON GUN WITH ELECTRON BEAM MODULATED BY AN OPTICAL DEVICE

BACKGROUND OF THE INVENTION

1. Field of the Invention

The present invention relates to electron guns that can be used to supply a modulated electron beam in an electron tube oscillator or amplifier, or in particle beam accelerator injectors, or the like.

2. Prior Art

There is known from the prior art, through articles and U.S. Pat. No. 4,313,072, electron tubes termed "lasertrons" that employ an electron gun in which the electron beam is modulated by laser pulses illuminating a photocathode. The present invention brings improvements to this technology by obviating the need for a laser.

In prior art lasertrons, a photocathode is illuminated by a laser beam whose wavelength is chosen in terms of the work function of the material constituting the photocathode. Accordingly, a laser beam pulsed at a frequency F knocks out electron packets from the photocathode at the same frequency F. These electron packets are then accelerated by an electrostatic field and thus acquire kinetic energy. They then cross a cavity resonant at frequency F and their kinetic energy is transformed into electromagnetic energy of frequency F. The energy is drawn off from the cavity by coupling it to an external user circuit.

In FIGS. 1 and 2, two embodiments of prior art lasertrons are represented schematically in longitudinal cross-sectional views.

In these figures, numeral 1 designates the photocathode, numeral 2 the laser beam, and numeral 3 the electron beam.

In the embodiment of FIG. 1, the photocathode is illuminated at an oblique angle by a laser beam 2 and the electron beam 3 propagates along the tube's longitudinal axis XX'.

In the embodiment of FIG. 2, the laser beam 2 and the electron beam 3 propagate along the tube's longitudinal axis XX', but in the opposite direction.

The laser beam 2 is thus normal to the photocathode's emissive surface.

The electron beam 3 is accelerated by the electrostatic electric field created by the anode 4, and then enters a cavity 5 resonant at frequency F. The electron beam is then received by a collector 6. The electromagnetic energy at frequency F is drawn off at the cavity 5 by coupling the latter to an external user circuit, using a waveguide 7 associated to a window 8, as shown in FIG. 1, or by a loop, as shown in FIG. 2.

The interest in having electron guns modulated in this manner is that it allows the tubes to be made very compact.

In lasertrons, electron packets are knocked out of the photocathode at frequency F; these electrons are thus naturally grouped from the outset, whereas in tubes such as klystrons several cavities are required to form packets of electrons from an initially continuous electron beam. The electron packets can also be injected into particle accelerators operating at frequency F.

The drawback with electron guns pulsed in this manner is that they are limited in frequency and in power.

For instance, to produce high powers, a large current needs to be drawn, which calls for a photocathode having a large surface and involves passing a sizeable beam into the lasertron cavity. This in turn requires that the lasertron cavity dimensions be sufficiently large to accommodate the passing electron beam, which limits the operating frequency. Moreover, the use of a large-size cavity produces a poor coupling between the beam and the cavity, which adversely affects efficiency.

Furthermore, the maximum obtainable modulation frequency for an electron gun modulated by illuminating pulses form a laser is limited by pulsed laser technology.

The electron guns embodied in FIGS. 1 and 2 have the following drawbacks regarding the use of a laser illuminating source:

- the photocathode's photoelectric efficiency is not optimal at the wavelengths currently supplied by lasers;
- the modulation frequency F is limited by the state of the art of laser pulse modulation;
- to overcome the above-mentioned drawbacks in the prior art, ancillary devices are added to the system to obtain a better adapted wavelength and to control the laser modulation as best as possible.

the bulk, weight, complexity and cost of the pulse-modulated illuminating system are inconvenient for practical applications.

In theory, lasertrons could develop very high RF energy levels with excellent efficiency (several megawatts peak power with an efficiency on the order of 70%, i.e. twice or one and a half that obtainable with a pulsed klystron). However, in the state of the art, there remain technical problems with existing devices.

The technology involving a gun excited by a laser essentially rests on the cathode and the laser. The progress in photocathode (GaAs. . . field emission cathodes) is encouraging if still insufficient. Several tens of amps are easily obtainable in laboratory conditions ;however the objective is on the order of a kA for a period of 50 to 100 picoseconds. As for the laser, which is located outside the tube itself, there still remains a number of basic difficulties to resolve before a making judgement. The invention covered by the present patent application proposes to replace the laser by a much simpler source.

Lasers, which can e.g. be YAG lasers, have low efficiencies and their setting up conditions are critical. The excitation of the photocathode requires very short wavelengths, e.g. in the ultraviolet (UV) region in order to have a good photo-electron conversion efficiency. Since laser emission wavelengths are generally greater than desired, a light frequency multiplying device is added to the system. Such multipliers work satisfactorily, but further complicate the system, which then becomes even more critical. Moreover, efficiency is further diminished.

But an even greater drawback lies in that it is extremely difficult to modulate lasers in microwave pulses. The present problem confronting laser manufacturers is the impossibility of producing the signals necessary for properly operating the lasertron, and shown in FIG. 3. In each micropulse of width the micropulse frequency corresponds to that of the laser or the frequency multiplier; the frequency 1/T of these micropulses is the microwave frequency, several GHz, which the "lasertron" tube is to amplify. The best prototypes are limited to several tens of micropulses at approximately 250 MHz with variable intensity (FIG. 4).

SUMMARY OF THE INVENTION

The aim of the present invention is precisely to overcome the drawbacks and to exceed the performance limits imposed by the use of a pulsed laser to stimulate the cathode of an electrod gun. These aims are achieved, as will be explained further, by replacing the laser with another illuminating source and a device for the modulation of said light interposed between said illuminating source and said photocathode.

Thus, the illuminating source, e.g. a gas discharge lamp, according to the invention, can be chosen as a function of the emission wavelength so that the photoelectric efficiency of the photocathode can be optimized without recourse to a light frequency multiplying device, as required in prior art.

Moreover, the modulation frequency F of the electron gun according to the invention is not limited by the characteristics of the illuminating source as in prior art.

Indeed, the maximum modulation frequency depends on the time required to switch the modulation device interposed between the illuminating source and the photocathode according to the invention, making it possible to modulate at much higher frequencies than previously possible (an increase by an order of magnitude can easily be attained in the laboratory).

Moreover, the bulk, weight, complexity, and cost of the electron gun system according to the invention are considerably reduced by eliminating the laser, frequency multiplier and associated control electronics, in favour of a more commonplace and less critical illuminating source modulated by a device that is very simple to modulate.

To achieve these aims, the present invention proposes an electron gun intended for emitting a beam modulated by microwaves at a frequency F, having as an electron source a photocathode, and a photocathode illumination source, wherein said illumination source can be an incoherent light source, and an optical modulator is interposed between said illumination source and said photocathode, said optical modulator being controlled at said frequency F to modulate the illumination coming from said source to said cathode at a high frequency F.

Thus, instead of using a pulsed laser with the above-mentioned drawbacks, a much simpler illumination source is used, which does not need to be a source of coherent, monochromatic, parallel or pulsed light, since its output is subsequently modulated by an optical modulator establishing the desired frequency by the light pulses; by varying the optical modulation rate the cathode illumination becomes controllable—in contrast with laser illumination—making it possible to use the thus-modulated electron gun in amplifier tubes where the signals can be encoded in amplitude modulation (AM) or frequency modulation (FM).

To obtain cathode currents of 10 A or more mentioned earlier, the luminous excitation power levels are relatively modest. The theoretical photoelectric efficiency of a CsGaAs cathode is on the order of 60 mA/-Watt luminous power in a suitable spectral band (e.g. UV), which corresponds to results already obtained in the laboratory (4 A for 187 W).

It happens that there are luminous sources other than lasers that are rugged, compact and emissive in a narrow spectral band as required for a good photoelectric efficiency: among them are classical gas discharge lamps emissive in the visible, infrared or even UV regions of the spectrum, some of which can deliver several hundreds of Watts.

Such lamps are followed by an optical modulator, e.g. of the electrooptical type.

The modulator can be comprised of several optical modulation elements, e.g. variable polarisation crystals controlled by an electromagnetic field associated to polarizers and filters, sensitive to an RF signal and having an extremely short response time.

According to a particularly important characteristic of the invention, the optical modulator can modulate the light beam from an RF signal. This RF signal is in the form of an electromagnetic field surrounding the modulator and controlling the latter directly.

These modulators can e.g. be Pockels cells which the main element is a variable polarisation crystal sensitive to the electric field and having an extremely short response time. Using such cells associated to what is termed a polarizer plate, and a second serving as a filter, it is currently possible to obtain 100% modulation (opaque blackness to complete transparency) at several hundred MHz. And new, experimentally proven processes can provide very good modulation at up to 5–10 GHz range. Indeed, the modulation of the Pockels cell can be can be obtained by placing the variable polarization crystal within a resonator or a microwave electromagnetic circuit, at a place where the electric field is large. If the modulator circuit has a large bandwidth, nothing prevents the vacuum tube from having this same bandwidth. The overall dimensions of the system are small, e.g. 5 cubic centimeters at 5 GHz.

According to another characteristic, the optical modulator is e.g. a Kerr cell containing an insulating liquid having a variable birefringence in the presence of a variable electric field.

The use of Cotton-Mouton cell could raise problems regarding response time.

In this way, the modulation of the electron beam according to the invention is controlled in a very simple manner and makes it possible to use the gun in an oscillator tube by performing modulation control with a part of the output signal, or in an amplifier tube by using a small signal drawn from the RF signal to be amplified.

The electron gun according to the invention is usable for microwave oscillator or amplifier tubes, as well as particle accelerator injectors. The microwave tubes can be klystrodes, klystrons, traveling wave tubes or "lasertrons", for example.

The "lasertron" vacuum tube per se still remains the same, in all of its versions, and in particular those described in patent documents U.S. Pat. No. 4,313,0782 and French patent 86 07826 (multiple beams).

However, the implementation of the present invention eliminates the laser requirement and its consequent drawbacks. The electron gun according to the invention, excited by by a non-coherent lamp and modulated by an electrooptical system such as a high frequency (GHz) Pockels cell can be used to supply a modulated electron beam for electron tubes, particle accelerators, or any other application requiring a high-current electron beam pulsed at a high frequency.

Furthermore, the frequency and amplitude of the modulation are simultaneously controllable, as is the pulse shape of the micropulses. Accordingly, the lasertron utilising the proposed system is a genuine amplifier capable of excellent linearity when the micropulses are similar to those of a grid tube working in class C.

Naturally, this device can be used not only in place of a lasertron for very high frequencies, but also in place of klystrodes at low frequencies. The latter implementation would eliminate the weak points of the klystrode, namely its mechanically fragile grid whose lifetime depends on its secondary emission evolution, and its very voluminous coaxial input cavity having a small bandwidth. But, like the klystrode, it would be a linear C-band amplifier and this aspect remains unchanged.

Indeed, as in the case of micro-pulsed tubes, the electron tube equipped with a device according to the invention does not work in class A: there cannot exist an unmodulated beam, the cathode remaining cold. This explains why the efficiency can be high.

Finally, the present invention can implemented either for an amplifier, the input signal being the signal that modulates the crystals and which then serves as the signal to be amplified, or for an oscillator in which the input signal can be drawn from the microwave output signal. This possibility is completely absent in the classical lasertron—even if it is assumed that the laser works correctly—since there is no microwave signal in the input system.

BRIEF DESCRIPTION OF THE DRAWINGS

Other objects, characteristics, and results of the invention shall become apparent from the following description, given as a non-limiting example and illustrated by the appended drawings in which.

DETAILED DESCRIPTION OF THE PREFERRED EMBODIMENTS

Figure 1:
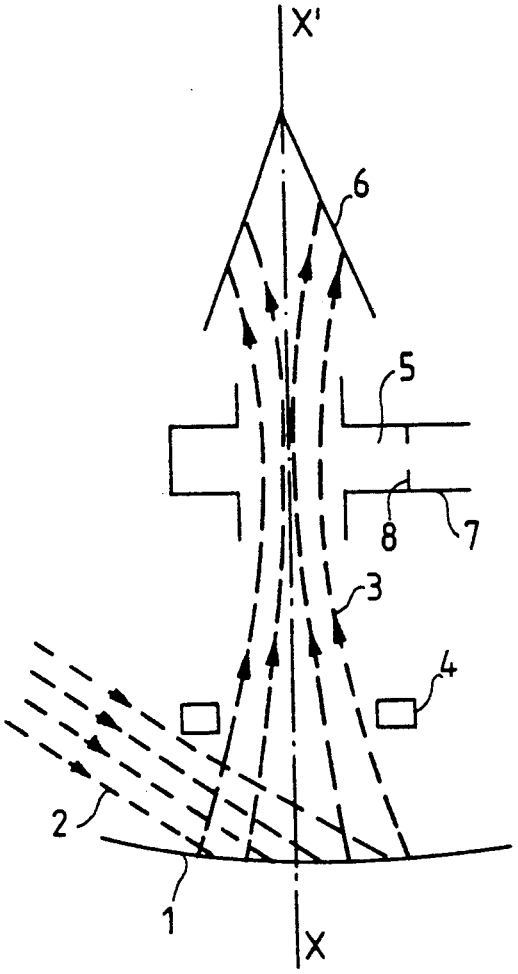
FIG. 1 PRIOR ART
FIGS. 1 and 2 are longitudinal cross-sectional view of two embodiments of prior art lasertrons.
Figure 2:
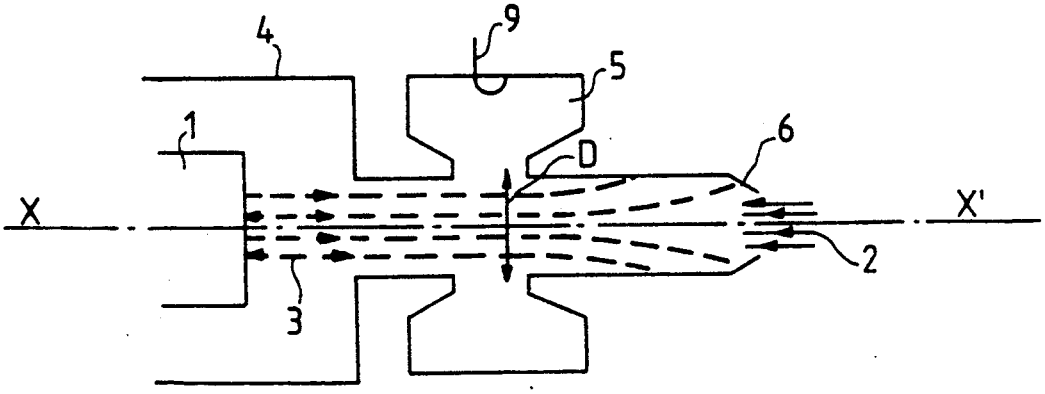
FIG. 2 PRIOR ART

FIGS. 1 and 2 have been described in the introduction to the description.

Figure 3:
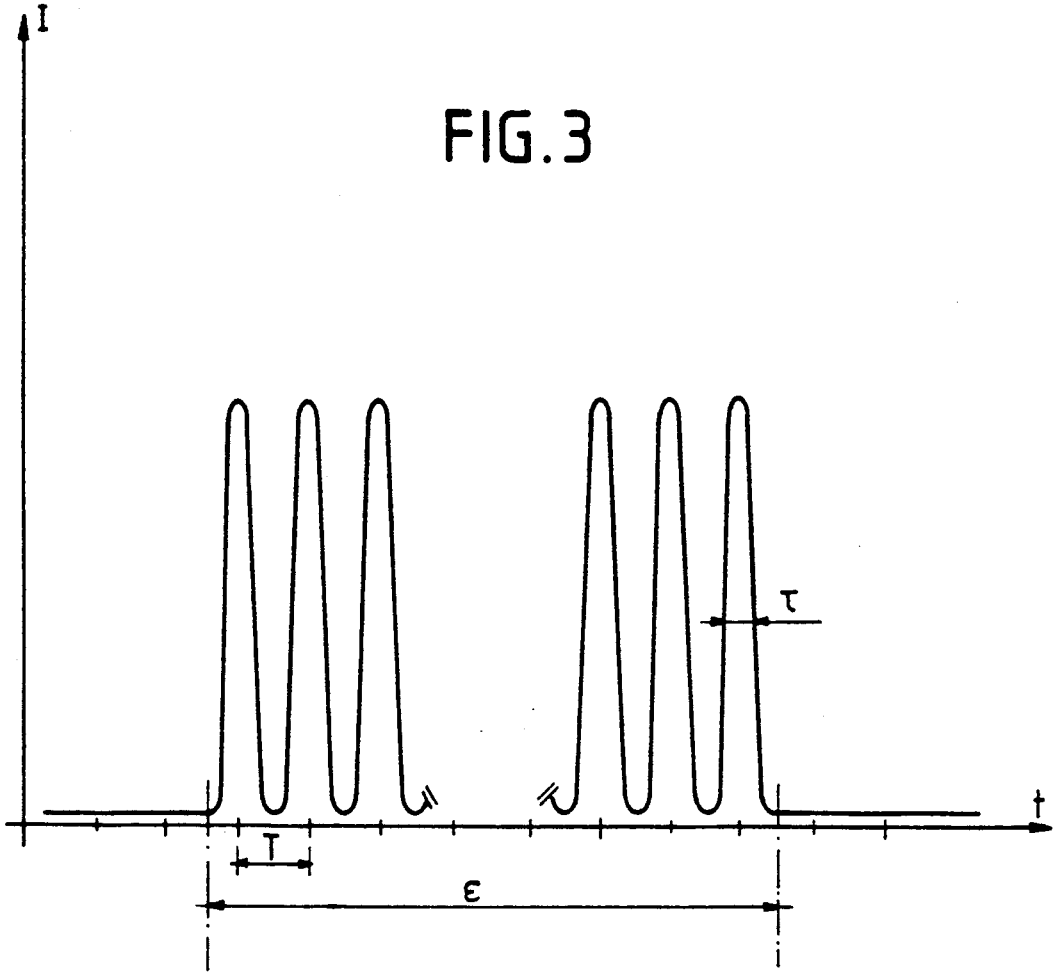
FIGS. 3 and 4 are ideal luminous excitation waveforms (FIG. 3) and those presently obtainable (FIG. 4) with a pulsed laser.

FIG. 3 shows the ideal waveforms of the light pulses to obtained the best operation from a high-frequency, high-current pulsed electron gun. A series of regularly-shaped, uniform pulses having a full-width half-maximum period to and regularly spaced in time by a period $T=1/F$, where F is modulating high frequency, is supplied over a period.

For practical applications, it is required that T be greater than or equal to 10− sec, with a repetition rate ranging from 1 KHz up to continuous mode.

T represents the period of the desired RF signal: for instance, $T=333\times10^{-13}$ sec for $F=3$ GHz.

Clearly, t will have to be less than T/2 in order to be able to distinguish the pulses. The efficiency of the lasertron or other RF oscillator or amplifier increases as t decreases, thus one tries to minimise t.

Finally, the number of electrons freed from the cathode at each light pulse varies with the integral of the pulse intensity, and the photoelectric efficiency is thus at a maximum with square—or almost square—pulses.

Figure 4:
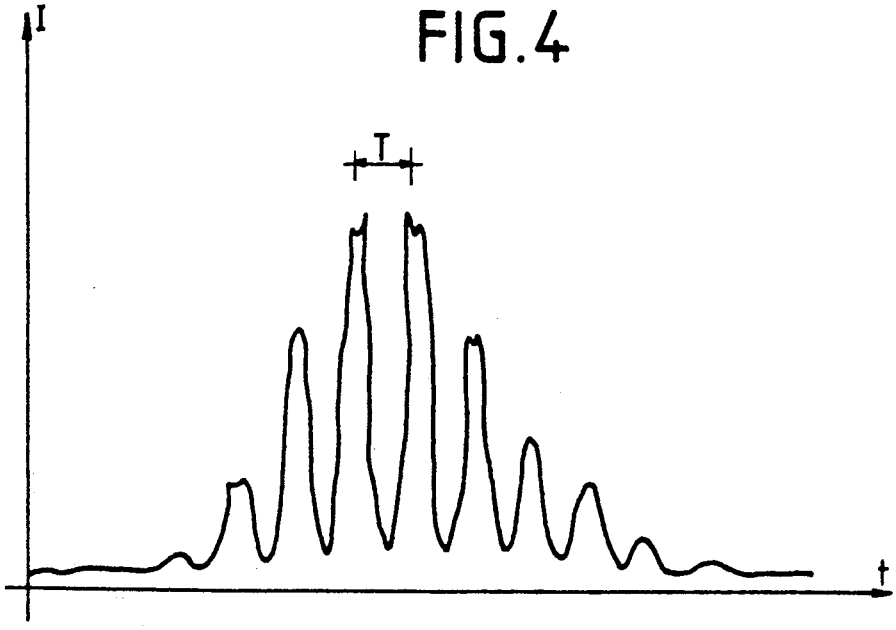

FIG. 4 shows the pulse shape obtained in the state of the art, using the output signal from a pulsed laser operating at 250 MHz maximum.

A comparison of FIG. 4 with FIG. 3 shows how far the state of the art is from the theoretical performance hoped for from the lasertron.

Figure 5:
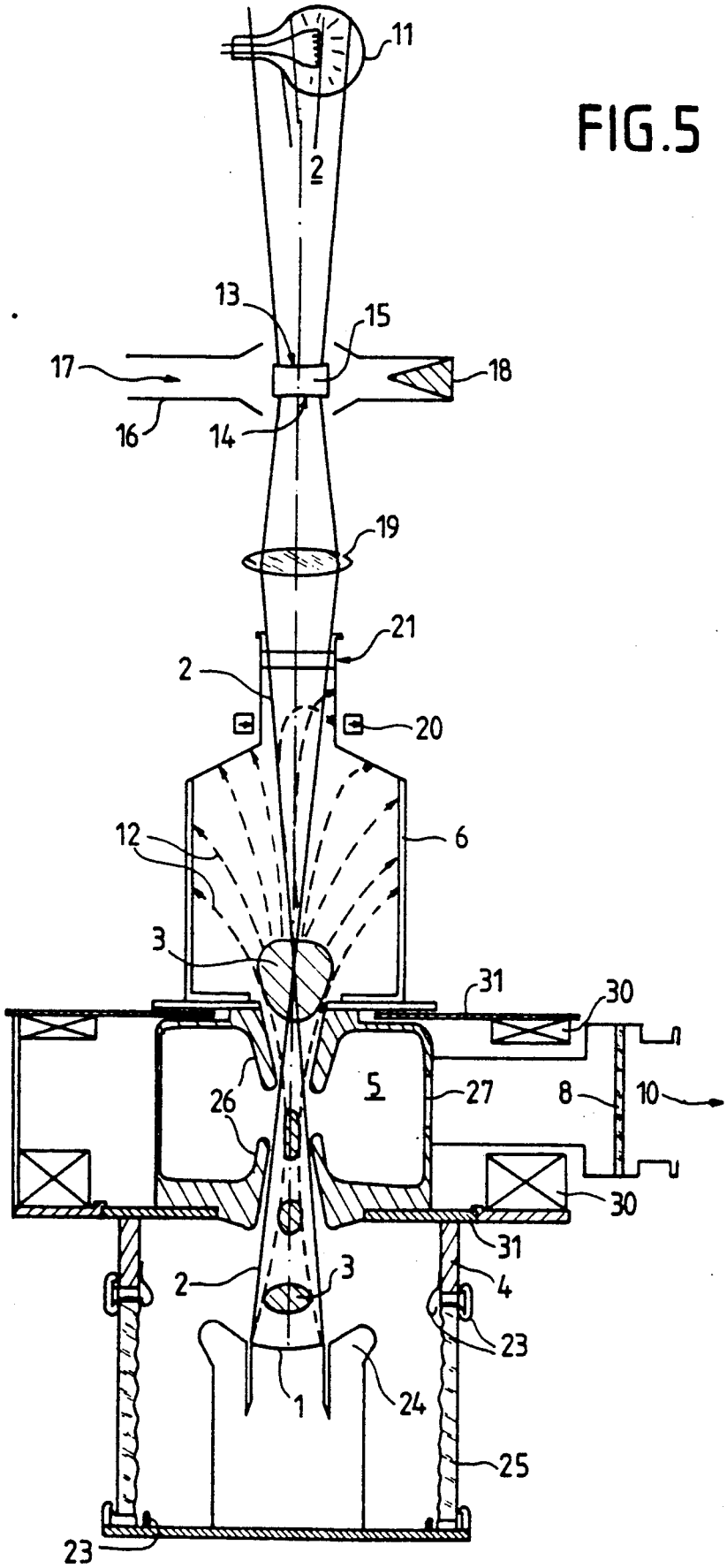
FIG. 5 is a longitudinal cross-sectional view of an example of an embodiment of a lasertron using an electron gun modulated by an optical system and non-coherent light according to the invention.

FIG. 5 shows a longitudinal cross-sectional view of a lasertron system in which the laser has been replaced by a lamp emitting non-coherent light modulated by an optical modulator according to the invention.

In the figure, the electron gun modulated according to the invention comprises a photocathode 1, and a source of non-coherent light 11 emitting light beams 2 which are modulated by an optical modulator. The latter can e.g. be an active polarisation modulation element 15 located between a focused on the photocathode by optical means 19, which can e.g. consist of a lens.

In the embodiment of the RF lasertron using an electron gun modulated according to the invention, as shown in FIG. 5, the active optical modulation element 15 can e.g. be a Pockels cell. To obtain the high-frequency RF light modulation, on the order of several GHz, a Pockels cell can be positioned in the waveguide 16 supplied with electromagnetic energy 17 at the desired frequency; it is the surrounding electromagnetic field that controls the modulation, and not the electrical signal supplied through conductors to the cell electrodes. Optionally, a matched load 18 in the guide could serve to stabilize the spectral purity of the RF signal.

The light 2 is focused by a lens 19 through a transparent window 21, which seals the vacuum within the lasertron, and onto the photocathode 16 which emits packets of electrons 3 at the frequency of the light stimulation as determined by the optical modulator 13, 14 and 15.

The electron packets are accelerated in the direction along the lasertron axis by a high-frequency voltage applied between the cathode and an anode 4 and other surrounding metallic elements 26, 31 which are usually grounded. High-voltage insulation between these elements is ensured by a ceramic part 25 and classical anti-corona devices 23.

The electron beam pulsed in packets 3 is focused by a focusing electrode 24 upon leaving the cathode and, in the drift regions 26, by a system of coils 30 that generate a substantially axial magnetic field confined between between the pole pieces 31.

After having gone through the cavities and drift regions, the electrons are no longer subject to focusing fields and mutually repel, so adopting diverging trajectories 12 to arrive at the collector 6 which dissipates their kinetic energy in a cooling system (not shown). A small transveral magnetic field is applied by magnets or electromagnets 20 to deflect the trajectories of the electrons and prevent them from impinging on the optical window 21.

The RF energy dissipated in the cavities 5 by the beam of electron packets 3 passes through an iris 27 and can be extracted into a load 10 (not shown), in which case there would be a microwave window 8 sealing the vacuum while being transparent to RF radiation.

The lasertron using a source of non-coherent light modulated by an optical modulation device according to the invention, as shown schematically in FIG. 5 features numerous advantages.

The optical modulation provides the possibility of obtaining much higher frequencies.

The photoelectric efficiency is better depending on the choice of the type of light source. For instance, the luminous power efficiency of a gas discharge lamp is better than that of a laser. The efficiency of the system is the product of both effects.

Since the optical modulation is obtained from an RF signal, the system can be used as an RF amplifier. By using an active polarization modulation element, such as a Pockels cell controlled by a microwave electromagnetic field surrounding this active element, the degree of polarization—and hence the intensity of the transmitted light—is adjustable by the amplitude of the controlling microwave electromagnetic field, while the modulation is at the frequency of the same microwave electromagnetic field. By drawing off an output signal and reinjecting it at the input of the optical modulation control, there is obtained an RF oscillator tube whose frequency depends on the dimensions of the resonant cavities of the tube using the gun according to the invention.

The invention relates to a microwave electron gun with an electron beam modulated by a non-coherent light optical device. The invention also relates to electron tube using an electron gun modulated according to the invention, and in particular lasertrons, klystrodes, klystrons, and traveling wave tubes.

What is claimed is:

1. An electron gun intended for emitting a beam modulated at a microwave frequency F, having as an electron source a photocathode, and a photocathode illumination source, wherein said illumination source is an incoherent light source, and an optical modulator is interposed between said illumination source and said photocathode, said optical modulator being controlled at said frequency F to modulate the illumination coming from said source to said cathode at said frequency F.

2. An electron gun intended for emitting an electron beam modulated at a microwave frequency F, having as an electron source a photocathode for generating the electron beam, an anode for providing an electrical field between the photocathode and the anode which accelerates electrons of the electron beam in free space, and a photocathode illuminating source, wherein an optical modulator is interposed between said illuminating source and said photocathode, said optical modulator being controlled at a frequency F by a high frequency ambient electromagnetic field surrounding said modulator, to modulate the illumination coming from said source to said cathode at said frequency F.

3. An electron gun as claimed in claim 1, wherein said optical modulator is controlled by a high frequency ambient electromagnetic field surrounding said modulator.

4. An electron gun as claimed in claim 2, wherein said optical modulator is a Pockels cell.

5. An electron gun as claimed in claim 2, wherein said optical modulator is a Kerr cell.

6. An electron gun as claimed in claim 1, wherein said illumination source is a gas discharge lamp.

7. A microwave amplifier tube comprising a circuit extracting kinetic energy of electrons, transforming said kinetic energy into microwave electromagnetic energy, wherein said tube comprises an electron gun as claimed in claim 1.

8. A microwave oscillator tube for generating an oscillating electromagnetic field output wherein said tube comprises an electron gun according to claim 1 and said optical modulator is controlled by a signal drawn off from said electromagnetic field output.

9. An injector for a particle accelerator wherein said injector comprises an electron gun according to claim 1.

10. An electron gun as claimed in claim 2, wherein said illumination source is a gas discharge lamp.

11. A microwave amplifier tube comprising a circuit extracting kinetic energy of electrons, transforming said kinetic energy into microwave electromagnetic energy, wherein said tube comprises an electron gun as claimed in claim 2.

12. A microwave oscillator tube for generating on oscillating electromagnetic field output wherein said tube comprises an electron gun according to claim 2 and said optical modulator is controlled by a signal drawn off from said electromagnetic field output.

13. An injector for a particle accelerator wherein said injector comprises an electron gun according to claim 2.

* * * * *